United States Patent [19]

Park

[11] 4,429,764

[45] Feb. 7, 1984

[54] SCAFFOLD SYSTEM FOR USE IN SANDBLASTING

[76] Inventor: John W. Park, 1820 Sweetwood Dr., Colma, Calif. 94015

[21] Appl. No.: 468,370

[22] Filed: Feb. 22, 1983

[51] Int. Cl.[3] ..... E04G 3/10

[52] U.S. Cl. ..... 182/129; 182/51; 182/142

[58] Field of Search ..... 182/129, 142, 51, 52; 15/250.11

[56] References Cited

U.S. PATENT DOCUMENTS

| | | | |
|---|---|---|---|
| 2,280,984 | 4/1942 | Thurnau | 182/51 |
| 2,723,885 | 11/1955 | Dietz | 182/57 |
| 3,566,991 | 3/1971 | Prouix | 182/129 |
| 3,990,536 | 11/1976 | Wilburn | 182/129 |
| 3,995,715 | 12/1976 | Virtanen | 182/129 |

*Primary Examiner*—R. P. Machado

*Attorney, Agent, or Firm*—Limbach, Limbach & Sutton

[57] ABSTRACT

The subject invention relates to a scaffold system for use in sandblasting. The scaffold system is intended to prevent particulates generated during the sandblasting operation from entering the atmosphere. This result is achieved by providing a platform having an enclosure formed on three sides thereof. A plurality of inverted pyramidal troughs are mounted in abutting side-by-side relationship on the lower surface of the platform. A conduit system is connected to the lower ends of the troughs. In use, particulates generated during the sandblasting operation are contained by the enclosure and directed into the troughs to be channeled by the conduit system to the ground.

10 Claims, 5 Drawing Figures

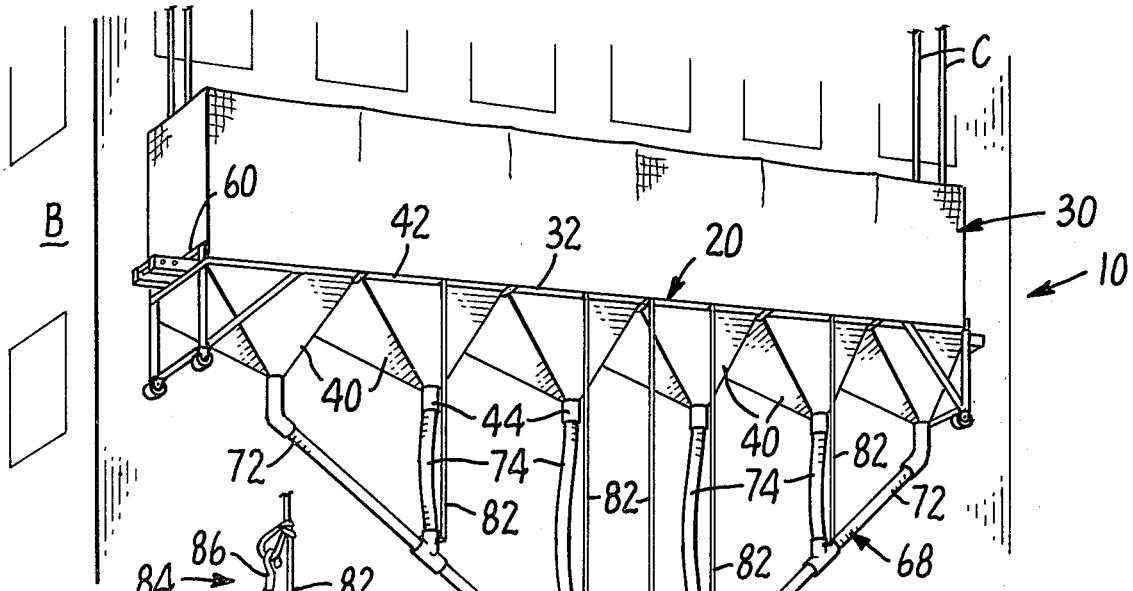
FIG. 1.
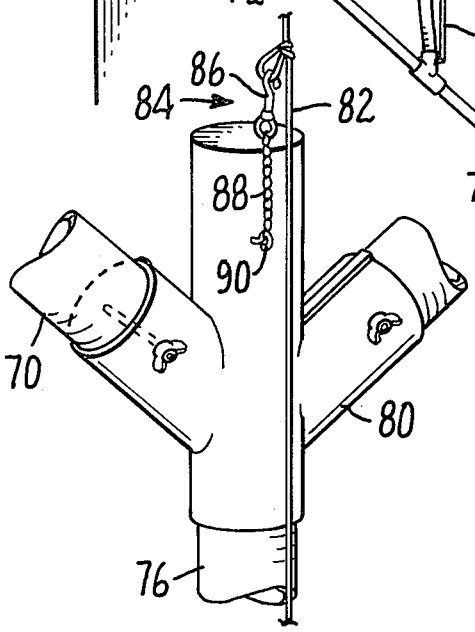
FIG. 2.
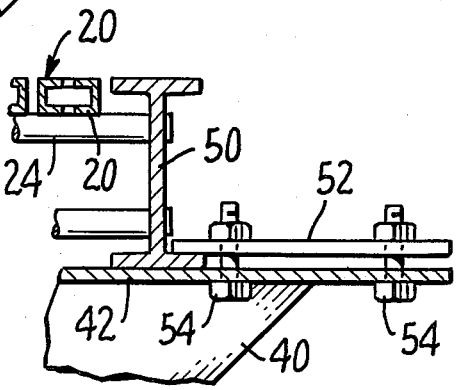
FIG. 4.
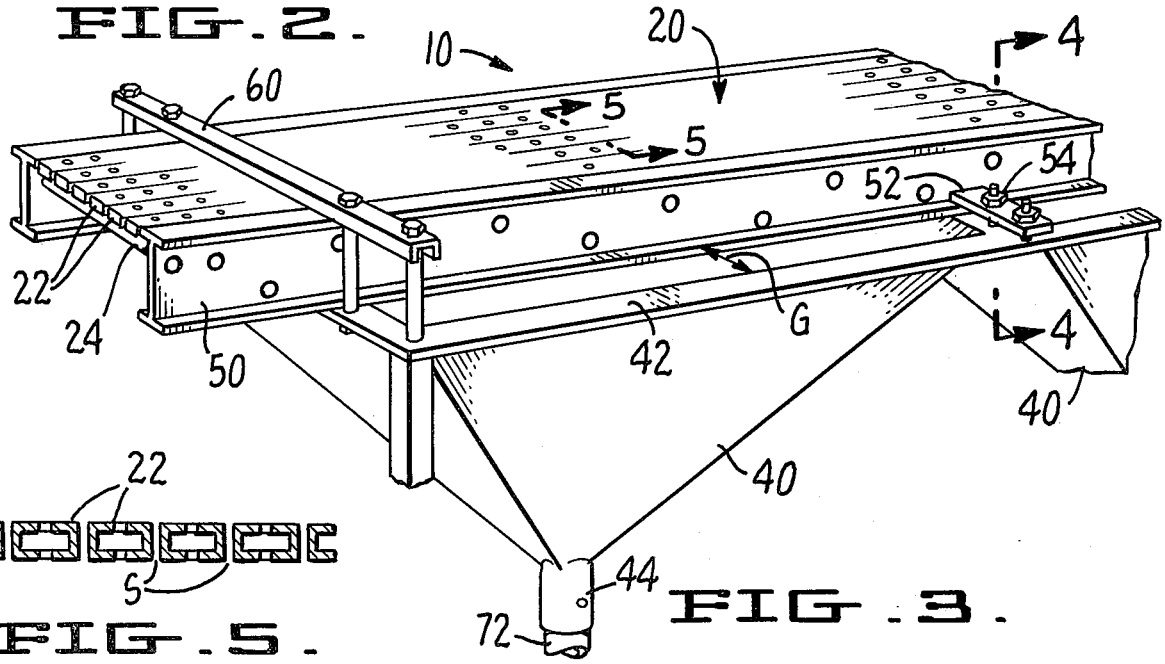
FIG. 3.
FIG. 5.

SCAFFOLD SYSTEM FOR USE IN SANDBLASTING

DESCRIPTION

TECHNICAL FIELD

The subject invention relates to a new and improved scaffold system. More particularly, a scaffold system is disclosed which is particularly adapted for use in a sandblasting operation. The subject scaffold is intended to prevent any particulate material generated during sandblasting from entering the atmosphere.

BACKGROUND ART

There are a variety of methods used to remove paint or other coatings from the surfaces of buildings. One common method called sandblasting consists of expelling sand under high pressure against the side of a building. The impingement of the sand against the building facade functions to loosen the paint on the building. When sandblasting operations are carried out on multistory buildings, various arrangements are made to raise the sandblasting equipment above ground level. Typically, some form of scaffold system is used to support workmen and the sandblasting equipment.

Many scaffold systems are known in the prior art and they need not be described in detail. Briefly, a typical scaffold systems consist of an elongated platform which is adapted to be raised vertically along the side of the building. The platform is supported by a plurality of cables which are typically connected through a pulley arrangement adjacent the roof of the building. By varying the length of the cables, the height of the platform can be adjusted.

In many cases, the use of sandblasting equipment has posed no serious environmental problems. However, as can be appreciated, in densely populated areas, it is highly undesirable to have the particulate residue of a sandblasting operation entering the atmosphere. Where buildings and population are relatively dense, the particulates can cause a noticeably adverse effect on air quality and, in addition, will pose rather annoying clean-up problems. Accordingly, various regulatory agencies have restricted the use of sandblasting operations in urban environments. Therefore, construction companies have been forced to utilize less attractive techniques for removing paint layers from the exterior of buildings. Accordingly, it would be desirable to provide a system which obviates the shortcomings of the prior art sandblasting operations.

The concept of capturing the residue generated when cleaning buildings has been addressed in the prior art. For example, U.S. Pat. No. 2,723,885, issued Nov. 15, 1955, to Dietz, discloses a window cleaning platform which includes a receptable for catching dirty water. The receptacle is mounted below the platform and captures the run-off which drains from the window ledge. As can be appreciated however, in a sandblasting operation particulate matter flies outwardly in all directions, such that the device illustrated in Deitz would be ineffectual in preventing the residue from entering the atmosphere.

Thus, it is an object of the subject invention to provide a new and improved scaffold system for use in sandblasting operations.

It is another object of the subject invention to provide a new and improved scaffold system which substantially inhibits the percentage of particulates entering the air during a sandblasting operation.

It is still a further object of the subject invention to provide a new and improved scaffold system which includes a plurality of troughs mounted to the lower surface of a platform for collecting particulates generated in a sandblasting operation.

It is still another object of the subject invention to provide a new and improved scaffold system which includes an enclosure means for channeling the particulate into the troughs connected to the platform.

It is still a further object of the subject invention to provide a new and improved scaffold system which includes a conduit means for channeling the residue of a sandblasting operation directly from the platform to a point on the ground.

SUMMARY OF THE INVENTION

In accordance with these and many other objects, the subject invention provides for a scaffold system adapted to be raised along the side of a building. More particularly, a scaffold system is disclosed which includes an elongated planar platform, defined by a plurality of longitudinal members mounted in parallel, spaced-apart relationship. A plurality of inverted pyramidal troughs are connected to the bottom surface of the platform, in abutting side-by-side relationship. The open upper ends of the troughs project outwardly beyond the edge of the platform. An enclosure means is provided which extends upwardly from the upper surface of the platform. The enclosure surrounds both ends of the platform and the side edge of the platform spaced away from the side of the building. By this arrangement, any particulates generated by the sandblasting operation are contained by the enclosure and directed into the troughs.

In accordance with the subject invention, a conduit means is also provided for channeling the particulates from the troughs directly to the ground. The conduit means includes a plurality of tube segments communicating with the open lower ends of each trough. Due to the weight of the sand, each tube segment is individually supported from the platform to insure that the segments do not rupture or disconnect from the system.

In the preferred embodiment, the troughs are mounted to the platform in a manner such that the upper surface of the platform is left unobstructed. By this arrangement, the likelihood of a worker tripping on the interconnections is substantially reduced.

Further objects and advantages of the subject invention will become apparent from the following detailed description taken in conjunction with the drawings in which:

BRIEF DESCRIPTION OF THE DRAWINGS

FIG. 1 is a perspective view of the scaffold system of the subject invention;

FIG. 2 is a partial, perspective view of the interconnection between conduit segments of the subject invention, and particularly illustrates the method of supporting the segments;

FIG. 3 is a partial, perspective view of the scaffold system of the subject invention, with parts removed for clarity;

FIG. 4 is an enlarged, cross-sectional view of the scaffold system of the subject invention taken along the line 4—4 of FIG. 3; and, FIG. 5 is a partial, cross-sectional view of the platform of the subject invention taken along the line 5—5 of FIG. 4.

DETAILED DESCRIPTION OF THE PREFERRED EMBODIMENT

Referring to FIGS. 1 through 5, the scaffold system 10, of the subject invention will be described in greater detail. More particularly, the scaffold system 10 includes an elongated platform 20. Platform 20 is formed from a plurality of elongated members 22 which are mounted in a spaced-apart, parallel array. Members 22 are supported at various points along the platform on cross beams 24. Members 22 are spaced apart in a manner to define a plurality of slots S, best seen in FIG. 5. As will be discussed more fully hereinbelow, the spacing S between members 22 permits particulates to drop through the platform and into the troughs below.

Platform 20 is intended to be suspended and raised adjacent the side of a building B as seen in FIG. 1. The platform is connected via cables C to a pulley system (not shown) mounted on the roof. By varying the length of the cables, the height of the platform can be adjusted.

In accordance with the subject invention, the scaffold system 10 further includes an enclosure means 30 for containing the particulate matter generated during the sandblasting operation. Enclosure 30 extends upwardly from the surface of platform 20 and surrounds the opposed side ends of the platform as well as the side edge 32 which is spaced away from building B. Enclosure means 30 may be formed from any material which is lightweight and has sufficient strength to contain the particulates generated in a sandblasting operation. One suitable material usable for the enclosure is canvas. The three-walled enclosure is intended to form a relatively air-tight seal with the building facade. In some situations, such as when the face of the building includes a plurality of projections, flexible grommet members (not shown) can be connected to the platform to insure that a reasonably air-tight seal is maintained.

In accordance with the subject invention, a means is provided for collecting the residue from the sandblasting operation and channeling it to the ground. As illustrated in FIG. 1, this means includes a plurality of inverted pyramidal troughs 40 mounted to the lower surface of the platform 20 in side-by side, abutting relationship. Each trough has an open upper end 42 and an outlet means 44 formed below the apex portion thereof. In the preferred embodiment, the upper end 42 of each trough projects outwardly beyond the side edges of the platform 20 as best seen in FIG. 3. By this arrangement, a gap G is defined providing a path through which a large portion of the particulates may enter the trough. The remainder of the particulates landing on the platform 22 are sifted through slots S and into the troughs 40.

As can be appreciated, during a sandblasting operation, workmen will walk along the upper surface of the platform. Accordingly, it would be desirable to provide a mounting means for the troughs 40 which leaves the majority of the platform unobstructed, thereby reducing the likelihood of tripping or other accidents. To achieve this result, a plurality of intermediate mounting means are provided which do not lie along the upper surface of the platform. More particularly, and as best seen in FIG. 4, in the preferred embodiment, the side edges 50 of platform 20 are structurally formed with an I-beam configuration in cross section. The upper surface 42 of the troughs 40 are placed in abutting contact with the lower surface of the I-beam structure. A mounting plate 52 is secured to the upper surface of the trough 42 with a portion of the I-beam structure 50 of the platform 20 interposed therebetween. Mounting plate 52 is secured to the upper surface of the platform via a plurality of bolts 54. The mounting structure illustrated in FIG. 4 is repeated at a plurality of fixed locations spaced along the length of the platform.

As illustrated in FIG. 3, an elongated supporting bar 60 can be connected to the troughs located each end of the platform. Support bar 60 is intended to be positioned outside of enclosure 30 as illustrated in FIG. 1 and therefore should pose no safety hazards. Bar 60 functions to provide added structural rigidity and support for the troughs 40.

In accordance with the subject invention, a conduit means is provided for channeling the particulate matter collected in the troughs directly to the ground. Due to the weight and flow characteristics of heavy particulate matter, a construction must be provided which will not rupture and will minimize clogging. Accordingly, no tube segments can be oriented at an angle less than 45 degrees from the vertical. In addition, a means must be provided for preventing the rupture of pipes due to the weight of the sand.

To achieve these objects, the conduit system 68 of the subject invention includes a substantially V-shaped branch tube 70, with the upper ends thereof 72 being in communication with the outlets 44 of the two troughs 40 disposed at the outer ends of platform 20. To satisfy the angular flow requirements, the angle D, measured between the two arms of the branch tube 70 must be 90 degrees or less. Conduit means 68 further includes a plurality of intermediate tube segments 74, extending from the outlets 44 of each of the remaining troughs 40 and being in communication with one of the arms of branch tube 70. The lengths of each segment 74 are varied to accommodate the distances between the associated outlets 44 and the branch 70. Preferably, all the tube of conduit means 68 are formed from a flexible material.

A central tube 76 is connected to the apex 78 of the V-shaped branch tube 70 and is of sufficient length to reach the ground. In the preferred embodiment, central tube 76 is formed from a plurality of segments (not shown). Each tube segment is on the order of 12 feet in length and is individually supported. By this arrangement, the weight of sand in the tubes will not cause any ruptures or dislodgement of the tubes from the platform 20.

Referring specifically to FIGS. 1 and 2, the support mechanism of the subject invention will be described in greater detail. More particularly, at the juncture between each pair of tube segments, some form of joint is provided. The exact configuration of the joint will, of course, depend upon the type of interconnection necessary at that point. FIG. 2 illustrates a joint 80 suitable for use at the apex of branch tube 70. The joints are formed from a sturdy material such as metal.

A cable 82 may be connected to the joint 80 via a link arrangement 84. The link arrangement can consist of a retractable clip 86 connected to a chain 88. Chain 88 is in turn connected to an eye hook 90. As illustrated in FIG. 1, each of the segments 74 in the conduit system 68 is individually supported by cables 82. In addition, each segment (not shown) of central tube 76 is also supported by a cable.

In accordance with the subject invention, a sandblasting operation may be carried out from the upper surface of platform 20. During this operation, pressurized sand is forced against the side of the building B, tending to loosen and remove paint and any other coatings. The pulverized sand and paint chips are contained by enclosure 30 and settle on platform 20. A portion of the particulates drop through slots S into the troughs 40. The remainder of the particulates enter the troughs through the gap G adjacent the side edges of the platform. The particulates then pass through the outlets 44 of the troughs and into the conduit means 68 to be channeled directly to the ground. By this arrangement, a high percentage of the particulates is prevented from entering the atmosphere, thereby protecting the environment.

While the subject invention has been described with reference to a preferred embodiment, it is to be understood that various other changes and modifications could be made therein by one skilled in the art without varying from the scope and spirit of the subject invention as defined by the appended claims.

What is claimed is:

1. A scaffold system adapted to be raised adjacent the side of a building, said system for use in a sandblasting operation, said system comprising:

an elongated planar platform;

a plurality of inverted pyramidal troughs connected to the bottom surface of said platform, each trough having an open upper end and an outlet means formed in the lower apex portion thereof, said troughs being mounted along the length of said platform in abutting, side-by-side relationship, with said troughs projecting outwardly beyond the elongated side edges of said platform;

conduit means connected to the outlet means of each said trough for channeling sand accumulated therein, downwardly;

enclosure means extending upwardly from the upper surface of said platform, said enclosure means surrounding both ends of said platform and the side edge thereof which is spaced away from the building, whereby when a sandblasting operation is carried out on said platform, sand particles and any material removed from the side of the building will be contained by said enclosure and directed into said troughs to be channeled by said conduit means directly to the ground.

2. A scaffold system as recited in claim 1 wherein said conduit means includes a V-shaped branch tube, with the two upper ends of said V-shaped branch tube being in communication with the outlet means of the two troughs located at the opposed ends of said platform, said conduit means further including a plurality of tube segments, with one end of each said tube segment being in communication with an outlet means of one of the remaining troughs, and with the other end of each said segment being connected to said V-shaped branch tube and in communication therewith, said conduit means further including a main central tube in communication with the apex portion of said V-shaped branch tube.

3. A conduit system as recited in claim 2 wherein said main central tube is formed from a plurality of interconnected tube segments.

4. A scaffold system as recited in claim 3 wherein each said tube segment of said central tube is independently supported via cable means connected to said platform.

5. A scaffold system as recited in claim 1 wherein said platform includes a plurality of slots permitting sand to drop therethrough into said troughs.

6. A scaffold system as recited in claim 5 wherein said platform is formed from a plurality of elongated members, mounted in a spaced-apart, parallel array in a manner to define said slots.

7. A scaffold system as recited in claim 1 wherein said troughs are connected to the bottom surface of said platform by a mounting means in a manner such that the upper surface of said platform is left unobstructed.

8. A scaffold system as recited in claim 7 wherein said elongated side edges of said platform are structurally formed with an I-beam configuration in cross section and wherein said mounting means includes a mounting plate, enabling the lower projecting edge of the I-beam structure to be interposed between said mounting plate and the upper surfaces of said troughs.

9. A scaffold system as recited in claim 8 wherein said mounting plate is secured to the upper surfaces of said troughs.

10. A scaffold system as recited in claim 9 wherein said mounting plate is secured to the upper surfaces of said troughs via bolts.

* * * * *